US005328064A

United States Patent [19]

Nanba et al.

[11] Patent Number: 5,328,064

[45] Date of Patent: Jul. 12, 1994

[54] MULTI-STEPPED SUBMERGED NOZZLE FOR CONTINUOUS CASTING

[75] Inventors: Yasutoshi Nanba; Kozo Kanamaru; Yukinobu Kurashina, all of Iwaki, Japan

[73] Assignee: Shinagawa Refractories Co., Ltd., Japan

[21] Appl. No.: 934,496

[22] PCT Filed: Apr. 30, 1991

[86] PCT No.: PCT/JP91/00589

§ 371 Date: Oct. 21, 1992

§ 102(e) Date: Oct. 21, 1992

[87] PCT Pub. No.: WO91/17008

PCT Pub. Date: Nov. 14, 1991

[30] Foreign Application Priority Data

May 8, 1990 [JP] Japan ..... 2-47390

[51] Int. Cl.[5] ..... B22D 41/50; B22D 41/54

[52] U.S. Cl. ..... 222/607; 164/437; 222/606

[58] Field of Search ..... 164/437; 222/591, 606, 222/607

[56] References Cited

U.S. PATENT DOCUMENTS

| | | | |
|---|---|---|---|
| 3,727,805 | 4/1973 | Shapland | 164/437 X |
| 3,907,022 | 9/1975 | Simons et al. | 164/437 X |
| 4,566,614 | 1/1986 | Frykendahl | 222/591 X |
| 4,877,705 | 10/1989 | Polidor | 222/591 X |

FOREIGN PATENT DOCUMENTS

| | | | |
|---|---|---|---|
| 872634 | 4/1953 | Fed. Rep. of Germany | 164/437 |
| 51-45620 | 4/1976 | Japan | 164/437 |
| 2-127950 | 5/1990 | Japan | 164/437 |
| 588059 | 4/1978 | U.S.S.R. | 164/437 |

*Primary Examiner*—J. Reed Batten, Jr.
*Attorney, Agent, or Firm*—Larson and Taylor

[57] ABSTRACT

The nozzle for continuous casting has a plurality of steps in the molten steel pouring hole of the nozzle. The dimension of the inside diameters of the steps to the inside diameter d of the main pipe is $d_1>d_2>d$ or $d_1>d_2d_3>d$, the inside diameter $d_2$ or $d_3$ immediately above the molten steel pouring outlet is $d+10\ mm \geqq d_2$ or $d_3$, and the material of the inner peripheral wall near the pouring outlet is boron nitride-carbon.

6 Claims, 5 Drawing Sheets

MULTI-STEPPED SUBMERGED NOZZLE FOR CONTINUOUS CASTING

TECHNICAL FIELD

This invention relates to an improvement in a submerged nozzle for continuous casting, and more particularly to a submerged nozzle for continuous casting, the molten steel pouring hole of which is provided with a plurality of steps.

PRIOR ART

A system of blowing inert gas is well-known as means for preventing a nozzle from fouling which impedes a multicontinuous casting and which is caused by adhesive sedimentation of an $Al_2O_3$ deposit to the inner wall of the submerged nozzle.

Further, in such kind of continuous casting there is proposed (as in Utility Model Publication No. 61-6987) a technique that intends to swallow up the scum and pour the melt in the non-oxidation state by means of a long nozzle which is connected to a ladle nozzle and only the submerging portion of which is made large-diameter, said submerging portion being submerged into the molten steel in a mold.

It is known that said system of blowing inert gas has the following disadvantages.

(1) As will be seen from FIG. 7, the fouling of the nozzle caused by the adhesion of deposit such as of $Al_2O_3$ takes place in the upper portion within the nozzle and in the inner surface near pouring outlet.

(2) If a gas blowing nozzle as illustrated in FIG. 6 is used to avoid the disadvantage (1) above, the inner surface of the pouring outlet of the nozzle vigorously melts down due to the bubbling agitation action of the inert gas.

SUMMARY OF THE INVENTION

The inventors of this invention have made their extensive researches in an attempt to avoid the various drawbacks of the known system. As a result, they have been successful in developing a multi-stepped submerged nozzle of the present invention. In the preferable technical constitution of the invention, a plurality of steps are provided in the molten steel pouring hole of a submerged nozzle for continuous casting, the inside diameters of said steps in the pouring hole to the inside diameter d of the main pipe is $d_1 > d_2 > d_3 \ldots d_n > d$, the inside diameter d of the main pipe is disposed in the respective spaces of said steps where $d_1 > d_n$ where n is greater than 1, said steps is arranged in the pouring direction of the molten steel in the order of the inside diameters $d_1 - d_n$, said steps may also be arranged doubly for the same inside diameter, $d_n$ is $d + 10\ \text{mm} \geqq d_n$, and the material of the inner peripheral wall close to the melt pouring outlet is boron nitride-carbon.

BEST MODE OF CARRYING OUT THE INVENTION

In order to solve the problems of a submerged nozzle in multi-continuous casting the following matters are important.

a) A deposit of $Al_2O_3$ is likely to take place in the upper, inner periphery of the submerged nozzle and the inner surface near the pouring outlet, and it is important to solve the means for avoiding the deposition.

b) It is also important to select a material to which an $Al_2O_3$ deposit hardly adheres.

Also in an attempt to solve these problems the inventors of this invention have made the invention.

EXAMPLES

The invention will now be described more in detail, by way of some examples, with reference to the accompanying drawings.

Figure 1:
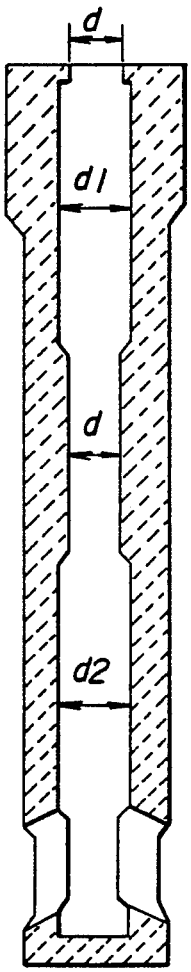
FIGS. 1, 2 and 8 are vertical sectional views showing embodiments of the invention.
Figure 2:
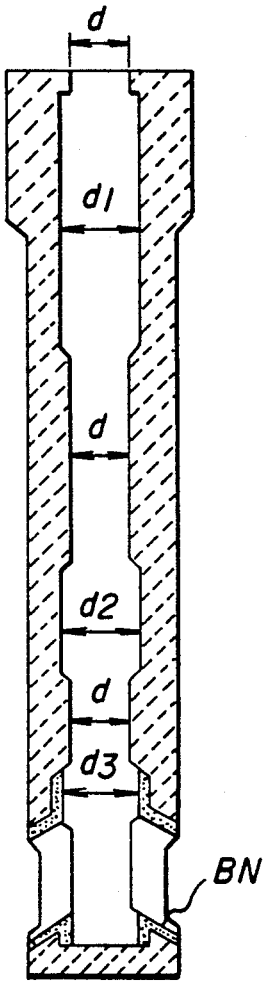
Figure 8:
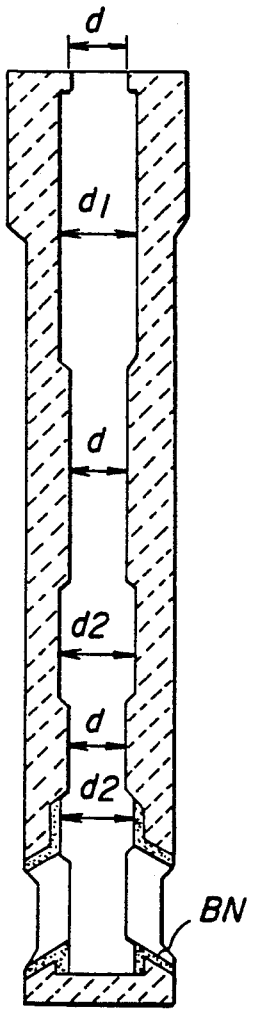

FIGS. 1 and 2 are vertical sectional views showing embodiments of nozzles of the present invention. FIG. 1 is an embodiment where the steps are double and the inside diameters of the molten steel pouring hole are $d_1 > d_2 > d$, while FIG. 2 is another embodiment where the steps are triple and the inside diameters of the pouring hole are $d_1 > d_2 > d_3 > d$. Further, FIG. 8 shows an embodiment in which steps of the same inside diameter are doubly provided, and in which the inside diameters of the molten steel pouring hole is $d_1 > d_2 > d_3 > d$.

Furthermore, the inside diameter d of the main pipe is provided between the respective spaces of the steps $d_1 - d_n$.

The other combination of the steps is of the following series.

Figure 3:
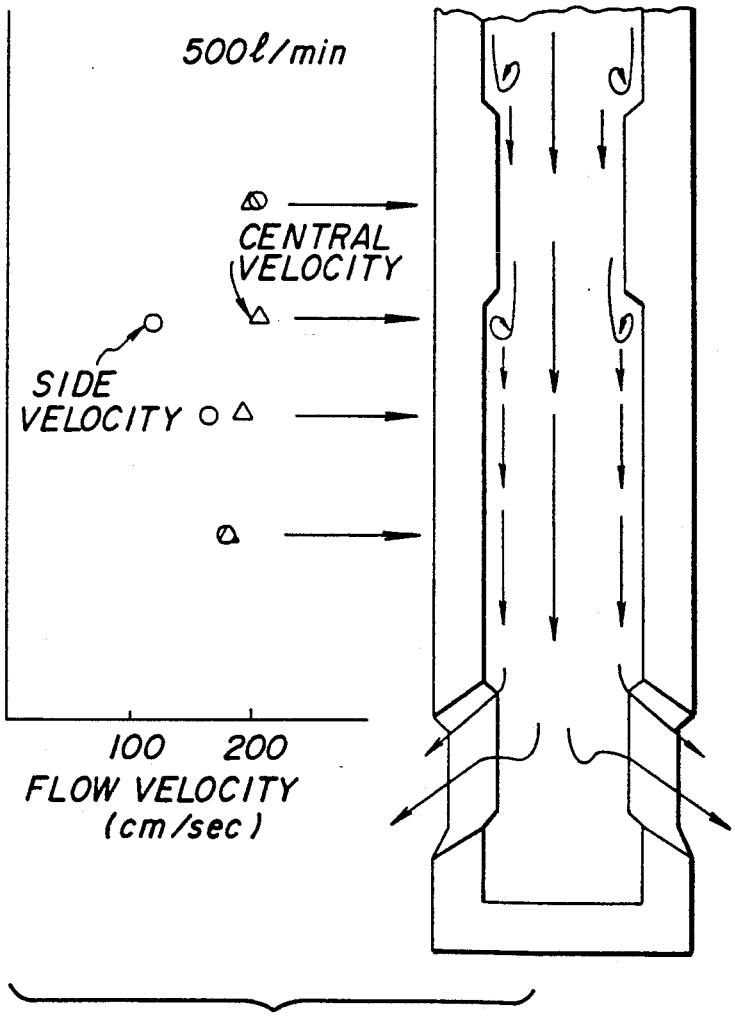
FIGS. 3 and 4 show relationships among the state, quantity and speed of the melt flow in the molten steel pouring hole of the present submerged nozzle.
Figure 4:
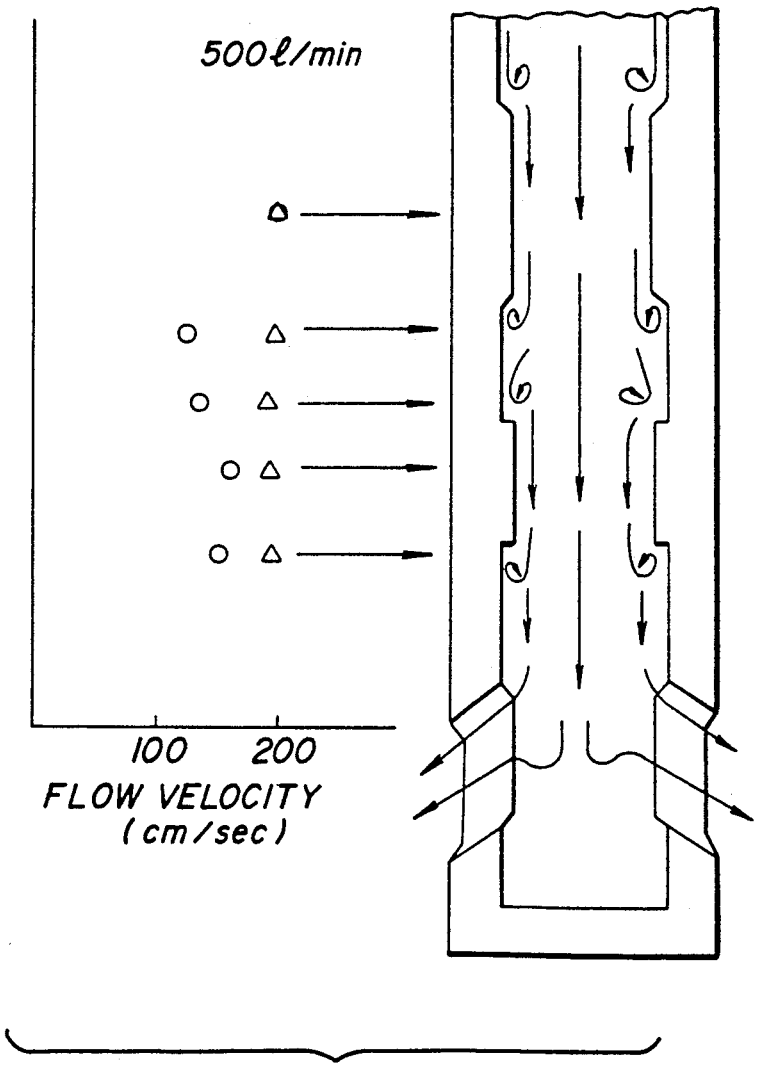
Figure 5:
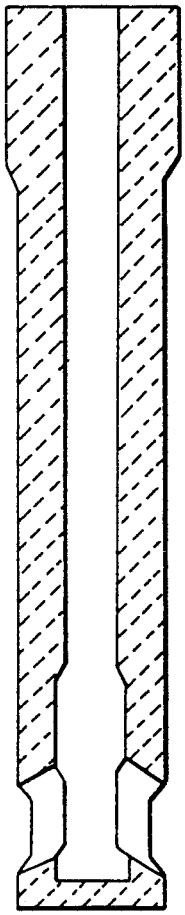
PRIOR ART Fig. 5
FIGS. 5 to 7 are vertical sectional views showing a conventional submerged nozzle and states of deposition of $Al_2O_3$ to the nozzle.
Figure 6:
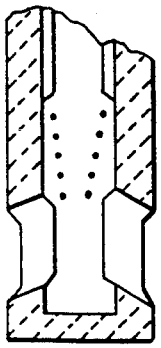
PRIOR ART Fig. 6
Figure 7:
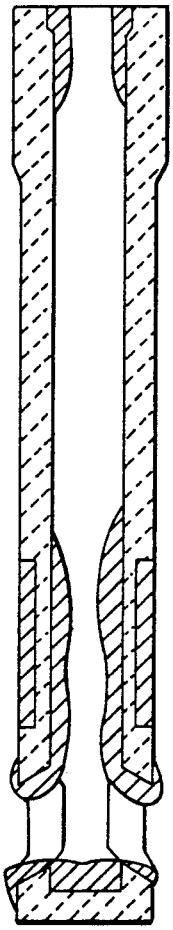
PRIOR ART Fig. 7

Triple-stepped case:

(a) $d \rightarrow d_1 \rightarrow d \rightarrow d_1 \rightarrow d - d_2$ (b) $d \rightarrow d_1 \rightarrow d \rightarrow d_2 \rightarrow d \rightarrow d_2$ Four-stepped case:

(a) $d \rightarrow d_1 \rightarrow d \rightarrow d_1 \rightarrow d \rightarrow d_2 \rightarrow d \rightarrow d_3$ (b) $d \rightarrow d_2 \rightarrow d \rightarrow d_2 \rightarrow d \rightarrow d_3 - d - d_3$ (c) $d \rightarrow d_1 \rightarrow d \rightarrow d_2 - d \rightarrow d_2 \rightarrow d \rightarrow d_3$ Five-stepped case:

(a) $d \rightarrow d_1 \rightarrow d \rightarrow d_1 \rightarrow d \rightarrow d_2 \rightarrow d \rightarrow d_2 \rightarrow d \rightarrow d_3$ (b) $d \rightarrow d_1 \rightarrow d \rightarrow d_1 \rightarrow d \rightarrow d_2 \rightarrow d \rightarrow d_3 \rightarrow d \rightarrow d_3$ (c) $d \rightarrow d_1 \rightarrow d \rightarrow d_2 \rightarrow d \rightarrow d_2 \rightarrow d \rightarrow d_3 \rightarrow d \rightarrow d_3$ FIG. 3 (two-stepped nozzle) and FIG. 4 (three-stepped nozzle) show the flow (shown with arrows) of the molten steel within the pouring hole of the submerged nozzles. As will be understood from FIGS. 3 and 4, a turbulence of flow takes place i.e. the flow of the molten steel changes in the pouring hole whereby the deposition of $Al_2O_3$ to the inner wall is effectively prevented.

In providing such steps in the submerged nozzles it has been noticed from experiments that the optimum inside diameters of the molten steel pouring hole is $d_1 > d_2 > d$ in the case of a double-stepped nozzle, and in the case of a triple-stepped nozzle the optimum diameters are $d_1 > d_2 > d_3 > d$. Additionally, the same result has been observed even if the inside diameters of the steps are of more than four different steps.

It has also been observed from the experiments that preferably the inside diameters $d_n$ of the melt pouring hole immediately above the melt pouring outlet is $d + 10\ mm \geqq d_n$.

On the other hand, it has also been noticed that the effect of preventing $Al_2O_3$ from deposition to the pouring hole is significant by using boron nitride-carbon (BN-C) as the material of the inner peripheral wall near the molten steel pouring hole.

The functions and effects of the invention will be enumerated as mentioned hereunder.

(1) A plurality of steps are provided in the inside diameters of the molten steel pouring hole of a submerged nozzle to prevent the melt flow from staying and generate a turbulence whereby $Al_2O_3$ is prevented from deposition.

(2) To product a significant effect for preventing $Al_2O_3$ from deposition a material for avoidance of deposition of $Al_2O_3$ is arranged in the inner wall near the molten steel pouring outlet.

(3) The life of the submerged nozzle of the invention has been improved by 50% compared with the known articles to enable a multi-pouring casting to be easily carried out.

INDUSTRIAL FIELD OF THE INVENTION

The invention is used for a submerged nozzle for continuous-pouring casting.

What is claimed is:

1. A multi-stepped submerged nozzle for continuous casting comprised of a molten steel pouring hole having a main pipe with an inside diameter d and a molten steel pouring outlet at the bottom of the nozzle characterized in that a plurality of steps having inside diameters $d_1 - d_n$ are provided in the molten steel pouring hole, the dimension of the inside diameters of said steps to the inside diameter d of the main pipe is $d_1 > d_2 > d_3 \ldots d_n > d$, and the inside diameter d of the main pipe is provided in the respective spaces between said steps $d_1 - d_n$.

2. The multi-stepped submerged nozzle for continuous casting as set forth in claim 1 wherein said n is 2 or more.

3. The multi-stepped submerged nozzle for continuous casting as set forth in claim 1 wherein said steps are arranged in the direction toward the bottom of the nozzle in the order of the inside diameters $d_1 - d_n$.

4. The multi-stepped submerged nozzle for continuous casting as set forth in claim 1 wherein steps of the same inside diameter are doubly arranged.

5. The multi-stepped submerged nozzle for continuous casting as set forth in claim 1 wherein the inside diameters $d_n$ immediately above the molten steel pouring outlet are $d + 10\ mm \geqq d_n$.

6. The multi-stepped submerged nozzle for continuous casting as set forth in claim 1 wherein the material of the inner peripheral wall near the molten steel pouring outlet is boron nitride-carbon.

* * * * *